US005396951A

United States Patent [19]

Ross

[11] Patent Number: 5,396,951

[45] Date of Patent: Mar. 14, 1995

[54] NON-EXPLOSIVE POWER CHARGE IGNITION

[75] Inventor: Richard J. Ross, Houston, Tex.

[73] Assignee: Baker Hughes Incorporated, Houston, Tex.

[21] Appl. No.: 962,430

[22] Filed: Oct. 16, 1992

[51] Int. Cl.[6] ..... E21B 23/04

[52] U.S. Cl. ..... 166/63; 166/65.1; 166/72

[58] Field of Search ..... 166/63, 299, 65.1, 72

[56] References Cited

U.S. PATENT DOCUMENTS

| | | | |
|---|---|---|---|
| Re. 25,846 | 8/1965 | Campbell . | |
| 50,617 | 10/1865 | Noble . | |
| 2,189,937 | 2/1940 | Broyles . | |
| 2,330,265 | 9/1943 | Burt . | |
| 2,381,929 | 8/1945 | Schlumberger | 166/1 |
| 2,618,343 | 11/1952 | Conrad | 166/13 |
| 2,637,402 | 6/1953 | Baker et al. . | |
| 2,640,547 | 6/1953 | Baker et al. . | |
| 2,681,701 | 6/1954 | Schlumberger . | |
| 2,692,023 | 10/1954 | Conrad . | |
| 2,695,064 | 11/1954 | Ragan . | |
| 2,815,816 | 12/1957 | Baker | 166/63 |
| 2,904,112 | 9/1959 | Wiley | 166/63 |
| 2,974,727 | 3/1961 | Goodwin | 166/63 X |
| 3,029,873 | 4/1962 | Hanes | 166/63 |
| 3,055,430 | 9/1962 | Campbell . | |
| 3,160,209 | 12/1964 | Bonner | 166/63 |
| 3,266,575 | 8/1966 | Owen . | |
| 3,363,559 | 1/1968 | Estes . | |
| 3,398,803 | 8/1968 | Leutwyler et al. | 166/63 X |
| 3,503,333 | 3/1970 | Estes . | |
| 3,518,943 | 7/1970 | Meers et al. . | |
| 5,024,270 | 6/1991 | Bostick . | |

*Primary Examiner*—Hoang C. Dang
*Attorney, Agent, or Firm*—Melvin A. Hunn

[57] ABSTRACT

A wellbore tool is provided to perform work in a wellbore by converting a chemical pressure source into a force exerted over a distance. The wellbore tool includes a pressure chamber sealed by a firing head and containing a power charge which includes a plurality of chemical components which are burned in a combustion reaction to generate gas. The combustion reaction of the power charge is initiated by a resistance heater which directly initiates the combustion reaction by receiving electrical energy and generating heat. The combustion reaction generates gas within the pressure chamber, the gas having a pressure which pushes a pressure responsive member into movement relative to the pressure chamber for providing a force over a distance to operate a downhole tool.

20 Claims, 4 Drawing Sheets

NON-EXPLOSIVE POWER CHARGE IGNITION

BACKGROUND OF THE INVENTION

1. Field of the Invention

This invention relates in general to a wellbore tool utilized for performing work within a wellbore by converting a chemical pressure source into a force exerted over a distance for operating force actuated downhole tools.

2. Background of the Invention

Prior art wellbore tools have been utilized to provide power for operating and setting downhole tools. One example of such a prior art wellbore tool is a cable conveyed bridge plug for setting within a cased wellbore such as that shown in U.S. Pat. No. 2,637,402, entitled "Pressure Operated Well Apparatus, " invented by R. C. Baker et al., and issued to Baker Oil Tools, Inc. on May 5, 1953. A similar cable conveyed wellbore tool is disclosed in U.S. Pat. No. 2,695,064, entitled "Well Packer Apparatus," invented by T. M. Ragan et al., and issued to Baker Oil Tools, Inc. on Nov. 23, 1954. These patents disclose cable conveyed wellbore tools for setting a bridge plug within a wellbore casing. Both of the cable conveyed wellbore tools include a prior art power charge for providing energy to set the bridge plug within the wellbore casing. These cable conveyed wellbore tools were actuated by the percussion of a firing pin causing a cartridge to explode and ignite the prior art power cartridge, or combustible charge.

Another example of prior art wellbore tool is the wireline conveyed well packer apparatus disclosed in U.S. Pat. No. Re. 25,846, entitled "Well Packer Apparatus," invented by D. G. Campbell, and issued to Baker Oil Tools, Inc. on Apr. 31, 1965. The wireline conveyed well packer apparatus disclosed includes a power charge which is ignited to generate gas for setting the well packer apparatus within a wellbore. The power charge is ignited by passing an electric current down the wireline and exploding an igniter cartridge, which causes a flame to ignite the power charge.

An example of a prior art power charge for use in a wellbore tool to generate gas is a combustion charge disclosed in U.S. Pat. No. 2,640,547, entitled "Gas-Operated Well Apparatus," invented by R. C. Baker et al., and issued to Baker Oil Tools, Inc. on Jun. 2, 1953. The combustion charge is comprised of combustion materials which, when ignited within a wellbore tool disclosed in the patent, will take at least one second for a maximum pressure to be attained within the wellbore tool. This prior art combustion charge includes both a fuel and a self-contained oxygen source. The combustion charge is ignited to generate a pressurized gas which provides a force for setting the gas-operated well apparatus. The combustion charge of the gas-operated well apparatus is ignited by exploding an igniter to start the combustion reaction for burning the combustion charge. The combustion charge, once ignited, burns in a self-sustained combustion reaction to generate the pressurized gas.

Another prior art wellbore tool is the wireline setting tool disclosed in U.S. Pat. No. 2,692,023, entitled "Pressure Operated Subsurface Well Apparatus," invented by M. B. Conrad, and issued to Baker Oil Tools, Inc. on Oct. 19, 1954. The wireline conveyed wellbore tool includes a power charge which is burned in a combustion reaction to generate a pressurized gas. The power charge is ignited by electrically exploding an igniter cartridge which then emits a flame to start the power charge burning. Combustion of the power charge generates pressurized gas having a pressure which provides force for operation of the wireline setting tool to set a downhole tool such as a packer or bridge plug within the wellbore.

Each of the above-referenced patents, U.S. Pat. Nos. 2,640,547, Re. 25,846, 2,695,064, 2,637,402, and 2,692,023, are hereby incorporated by reference as if fully set forth and disclosed herein.

As disclosed in the above-referenced devices, these prior art wellbore tools for converting the chemical components of a power charge into a mechanical force exerted over a distance require at least a separate igniter cartridge for igniting the power charge. Typically, explosive components are used for these prior art igniter materials, such as, for example, gunpowder or lead azide. These types of igniter materials are easily ignited and represent hazards both to operators utilizing these materials in wellbore tools, and to successful completion of wellsite operations. Some of these types of primary ignition or igniter materials are susceptible to ignition from applications of small amounts of electric current, or even discharge of static electricity.

Further, due to the hazards of these igniter materials, special procedures and equipment are required for both transporting and storing prior art igniter materials. Due to the relative ease with which these igniter materials may be ignited, they are typically stored and transported separately from power charge materials to prevent exposure of a large energy source contained within the power charge from such relatively volatile materials included within prior art igniters.

SUMMARY OF THE INVENTION

It is one objective of the present invention to provide a wellbore tool for performing work downhole within a wellbore, the wellbore tool having a power charge for use as a chemical pressure source which is ignited without use of explosive materials.

It is another objective of the present invention to provide a wellbore tool for performing work within a wellbore, the wellbore tool having a power charge which is ignited electrically, without use of explosive materials, to burn in a self-sustained combustion reaction to provide a pressurized gas.

It is yet another objective of the present invention to provide a wellbore tool for use to provide mechanical power for operating a downhole tool, the wellbore tool having an electrical resistance heater for directly initiating a self-sustained combustion reaction for burning a plurality of materials for generating pressurized gas.

It is further another objective of the present invention to provide a wellbore tool for providing a force over a distance to operate a downhole tool, the wellbore tool powered by a self-contained single power cartridge which includes a resistance heater for electrically igniting combustible materials within the power cartridge.

These objectives are achieved as is now described. A wellbore tool is provided to perform work in a wellbore by converting a chemical pressure source into a force exerted over a distance. The wellbore tool includes a pressure chamber, which is sealed by a firing head and contains a power charge having a plurality of chemical components which are burned in a combustion reaction to generate gas. The combustion reaction of the power charge is initiated by a resistance heater which directly initiates the combustion reaction by receiving electrical energy and generating heat. The combustion reaction generates gas within the pressure chamber, the gas having a pressure which pushes a pressure responsive member into movement relative to the pressure chamber for providing a force over a distance to operate a downhole tool.

In the preferred embodiment of the present invention, a wireline conveyed setting tool is provided for converting a self-contained solid propellant into a force extended over a distance for urging a settable wellbore tool into gripping and sealing engagement within a wellbore. The setting tool includes a pressure chamber which is sealed by a firing head and contains a power charge. The power charge includes both the self-contained solid propellant and a resistance heater for igniting the self-contained solid propellant. The resistance heater converts electrical energy into heat for directly initiating a self-sustained combustion reaction in which the solid propellant is burned to generate pressurized gas. The pressurized gas exerts a pressure which pushes against a pressure responsive member to move the pressure responsive member for urging a sleeve to move relative to a mandrel for setting the settable wellbore tool into gripping and sealing engagement within the wellbore.

Additional objects, features and advantages will be apparent in the written description which follows.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
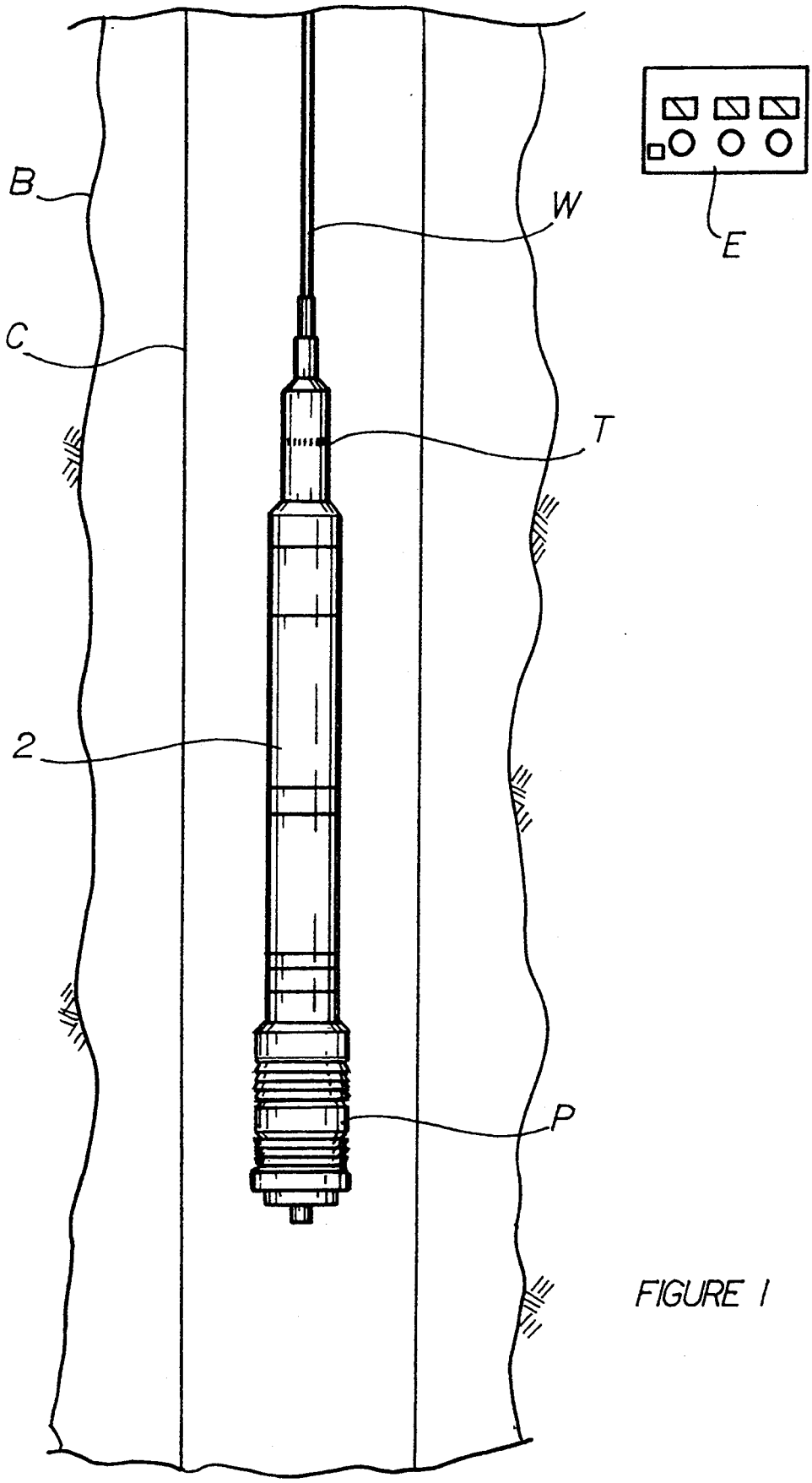
FIG. 1 is a partial longitudinal section view of a wellbore depicting a wireline tool string which includes the wireline setting tool of the preferred embodiment of the present invention.

Referring to FIG. 1, a partial longitudinal section view depicts a wellbore B having a casing C within which a wireline tool string T is secured to wireline W. An electrical power supply E is schematically shown for providing power to tool string T. Wireline tool string T includes wellbore tool 2 which, in the preferred embodiment of the present invention, is a wireline setting tool. Tool string T further includes a packer P which is releasably secured to wellbore tool 2 for positioning and setting within casing C.

Figure 2:
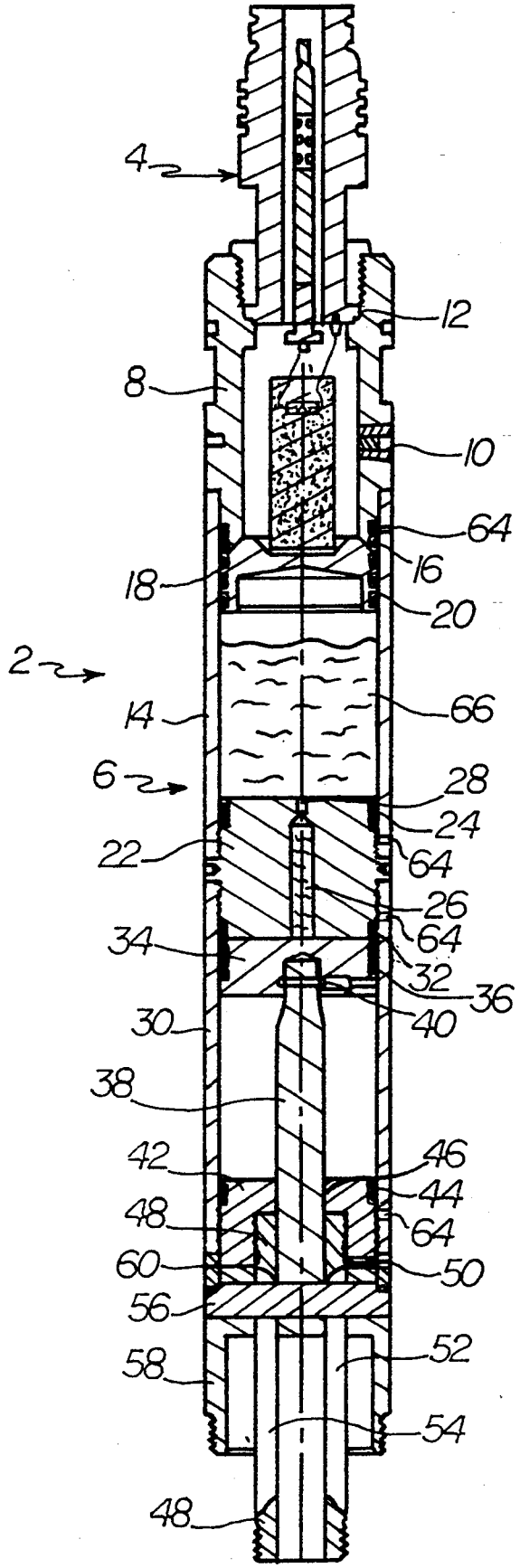
FIG. 2 is a longitudinal section view of a wireline setting tool of the preferred embodiment of the present invention, shown prior to actuation.

With reference to FIG. 2, a longitudinal section view shows wellbore tool 2 shown prior to actuation. In the preferred embodiment of the present invention, wellbore tool 2 is a wireline setting tool having an elongated tubular body, and including firing head 4 and pressure setting tool 6.

Pressure setting tool 6 includes pressure chamber 8. Pressure chamber 8 includes a manual bleeder valve 10 for selectively bleeding pressure from within pressure chamber 8 after operation of wellbore tool 2. An upper end of pressure chamber 8 threadingly engages firing head 4 and fluid flow therebetween is prevented by seal 12.

Upper cylinder 14 is threadingly coupled to a lower end of pressure chamber 8, and seal 16 prevents fluid flow therebetween. Within upper cylinder 14 is floating piston 18, which is a pressure responsive member. Floating piston 18 is movable within upper cylinder 14 and, during operation of wellbore tool 2, is urged to move downward by gas pressure within pressure chamber 8. Seal 20 prevents fluid flow between an outer circumference of floating piston 18 and an interior diameter of upper cylinder 14.

Cylinder connector 22 is threadingly coupled to a lower end of upper cylinder 14. Seal 24 prevents fluid flow between an outer circumference of an upper end of cylinder connector 22 and an interior of the lower end of upper cylinder 14. Cylindrical connector 22 includes flow port 26 having orifice 28 which substantially measures three-sixteenths of an inch in diameter at an upper end of flow port 26.

Lower cylinder 30 has an upper end which is threadingly coupled to a lower portion of cylindrical connector 22. Seal 32 prevents fluid flow between an outer circumference of the lower end of cylindrical connector 22, and an interior of the upper end of lower cylinder 30.

Secondary piston 34 is disposed interiorly of and is movable within lower cylinder 30. Secondary piston 34 is a second pressure responsive member and is movable within lower cylinder 30. Seal 36 seals between an outer circumference of secondary piston 34 and an interior diameter of lower cylinder 30.

Piston rod 38 is secured to secondary piston 34 by lock pin 40, and is also movable within lower cylinder 30.

Cylinder head 42 is threadingly coupled to the lower end of lower cylinder 30. Seal 44 prevents fluid flow between the outer circumference of cylinder head 42 and the interior diameter of lower cylinder 30. Seal 46 prevents fluid flow between an interior surface of cylinder head 42 and an outer circumference of piston rod 38, which is movable with respect to cylinder head 42 and seal 46.

Mandrel 48 has an upper end which is threadingly secured within cylinder head 42. Set screw 50 prevents rotation of mandrel 48 within cylindrical head 42 after mandrel 48 is threadingly secured within cylindrical head 42. Mandrel 48 includes longitudinally extending slot 52, and longitudinally extending slot 54 which are two diametrically opposed longitudinally extending slots through an outer tubular wall of mandrel 48.

Cross link 56 inserts through longitudinally extending slot 52 and longitudinally extending slot 54, and is movable longitudinally within slots 52 and 54. Cross link 56 further inserts through piston rod 38 and sleeve 58 to couple sleeve 58 to piston rod 38. Cross link retaining ring 60 retains cross link 56 within sleeve 58 to maintain cross link 56 in engagement within sleeve 58 and piston rod 38. Lock screw 62 (not shown) secures cross link retaining ring 60 to sleeve 58.

Sleeve 58 is a driven member which is driven downward by piston rod 38 and cross link 56 when secondary piston 34 is urged into moving downward during operation of wellbore tool 2.

Pressure equalization ports 64 and manual bleeder valve 10 are provided for releasing fluid pressure from within pressure chamber 8, upper cylinder 14, and lower cylinder 30 after operation of wellbore tool 2. Pressure equalization ports 64 are provided at seal 16, seal 24, and seal 44. During disassembly of wellbore tool 2 after operation within wellbore B, thread pressure equalization ports 64 allow release of pressure from within wellbore tool 2 by passing over seal 16, seal 24, and seal 44, respectively, prior to the threaded connections of these seals being completely uncoupled. Thread pressure equalization ports 64 thus allow pressure to be released from the interior of wellbore tool 2 prior to fully uncoupling portions of wellbore tool 2.

Hydraulic fluid 66 is contained between floating piston 18 and secondary piston 34 to provide an intermediate fluidic medium for transferring force between floating piston 18 and secondary piston 34. As shown in FIG. 2, prior to actuating pressure setting tool 6, hydraulic fluid 66 is primarily disposed within upper cylinder 16.

During operation of pressure setting tool 6 to move sleeve 58 with respect to mandrel 48, a gas pressure generated within pressure chamber 8 urges floating piston 18 downward. Downward movement of floating piston 18 presses hydraulic fluid 66 through orifice 28 and flow port 26 to drive secondary piston 34 downward. Movement of secondary piston 34 downward within lower cylinder 30 causes piston rod 38, cross link 56, and sleeve 58 to move downward with respect to lower cylinder 30 and mandrel 48. Firing head 4, pressure chamber 8, upper cylinder 14, cylinder connector 22, lower cylinder 30, cylinder head 42, and mandrel 48 remain stationery as floating piston 18, hydraulic fluid 66, secondary piston 34, piston rod 38, cross link 56, sleeve 58, and cross link retaining ring 60 move within pressure setting tool 6.

Figure 3:
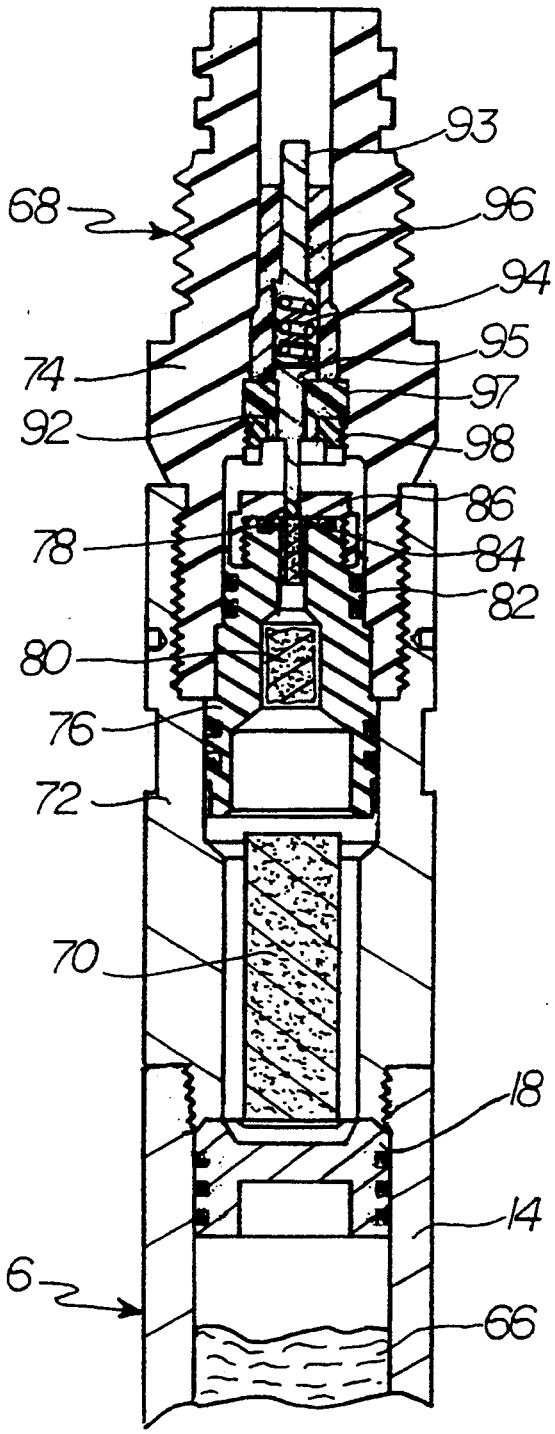
FIGURE 3 (PRIOR ART)
FIG. 3 is a longitudinal section view of a portion of a wireline setting tool having a prior art power charge, explosive igniters, firing head, and a pressure chamber.

Referring now to FIG. 3, a longitudinal section view depicts pressure setting tool 6 used in combination with prior art firing head 68, and prior art power charge 70 within pressure chamber 72. Prior art firing head 68 includes adapter 74, and explosive igniter housing 76. Explosive igniter housing 76 houses primary igniter 78, such as a BP3A primary igniter, and secondary igniter 80. BP3A primary igniters, secondary igniters, and prior art power charges, such as power charge 70, are manufactured by and available from Baker Oil Tools Inc., a division of Baker Hughes Inc., both of Houston, Tex. Both primary igniter 78 and secondary igniter 80 are prior art igniters which include explosive materials for igniting prior art power charge 70.

An upper end of adapter 74 is threaded for connection to a wireline tool string. A lower end of adapter 74 threadingly engages an upper end of pressure chamber 72. Explosive igniter housing 76 is threadingly coupled within the lower end of adapter 74 by a left-hand threaded connection. Seal 82 sealingly engages between an outer circumference of explosive igniter housing 76 and an interior diameter of pressure chamber 72 to prevent fluid flow therebetween. Seal 84 sealingly engages between an outer circumference of explosive igniter housing 76 and an interior diameter of the lower end of adapter 74 to prevent fluid flow therebetween.

Cartridge cap 86 retains primary igniter 78 within an upper end of explosive igniter housing 76. Seal 88 sealingly engages between cartridge cap 88 and primary igniter 78. Secondary igniter 80 is held within explosive igniter housing 76 by snap ring 90 (not shown).

Electrical connector assembly 92 is utilized to electrically connect a wireline, or wireline tool string, to primary igniter 78. Electrical connector assembly 92 includes upper connector pin 93, connector spring 94, and lower connector pin 95. Electrical connector assembly 92 is insulated by insulator sleeve 96 and pin insulator 97 to prevent electrical continuity between adapter 74 and electrical connector assembly 92. Connector lock ring 98 threadingly engages within adapter 74 to hold insulator sleeve 96, pin insulator 97, and electrical connector assembly 92 in place within adapter 74.

Connector spring 94 electrically connects between upper connector pin 93 and lower connector pin 95, and further it urges lower connector pin 95 downward and into contact with the upper end of prior art primary igniter 78.

With reference to FIGS. 1 and 3, prior art power charge 70 is ignited by passing electrical current from an electrical power supply, such power supply E, and through a wireline W to a wireline tool string T, through electrical connector assembly 92, and to primary igniter 78. Primary igniter 78 includes a gunpowder load which is ignited by the electrical current conducted through electrical connector assembly 92. Primary igniter 78 then ignites secondary igniter 80. Secondary igniter 80 generates heat which then ignites prior art power charge 70. Prior art power charge 70 then burns in a self-sustained combustion reaction to generate a gas having a pressure which pushes floating piston 18 downward.

Referring back to FIG. 2, downward movement of floating piston 18 presses hydraulic fluid 66 through orifice 28 and flow port 26 to urge secondary piston 34 downward. Piston rod 38, cross link 56, and sleeve 58 are connected to secondary piston 34. Movement of secondary piston 34 downward urges sleeve 58 to move relative to mandrel 48.

Figure 4:
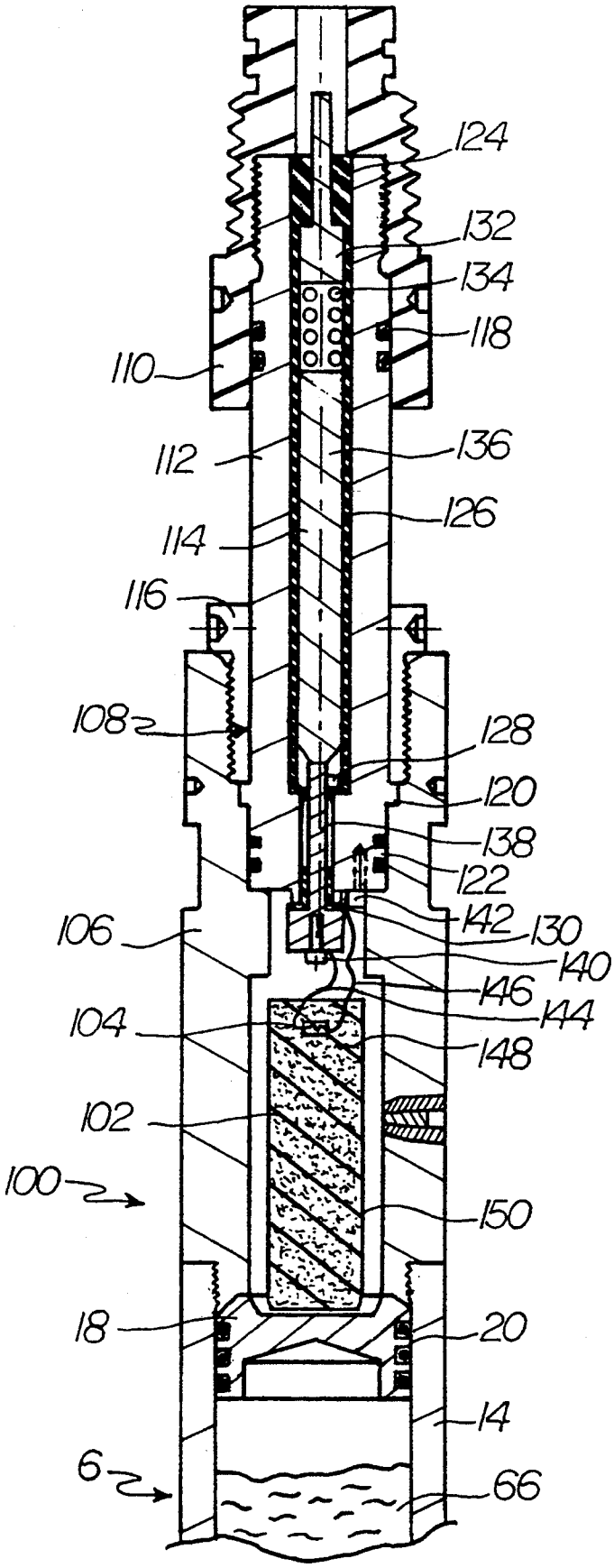
FIG. 4 is a longitudinal section view of a portion of a wireline setting tool of the preferred embodiment of the present invention, which includes a pressure chamber, a firing head, and a power charge having a resistance heater.

With reference to FIG. 4, a longitudinal section view depicts wellbore tool 100, which is the wireline setting tool of the preferred embodiment of the present invention depicted as wellbore tool 2 in FIG. 1. Wellbore tool 100 includes power charge 102 having resistance heater 104. Wellbore tool 100 further includes pressure setting tool 6 used with pressure chamber 106 and firing head 108. Although pressure chamber 106 is used with firing head 108 in the preferred embodiment of the present invention, in other embodiments of the present invention firing head 108 may be constructed for use with prior art pressure chamber 72 shown in FIG. 3.

Still referring to FIG. 4, in the preferred embodiment of the present invention, firing head 108 includes adapter 110, conductor housing 112, electrical conductor assembly 114, and housing lock ring 116. Conductor housing 112 is threadingly engaged within adapter 110. Seal 118 seals between an outer circumference of conductor housing 112 and an interior diameter of a lower end of adapter 110. A lower end of connector housing 112 includes shoulder 120 and is secured within pressure chamber 106 by housing lock ring 116 threadingly engaging within an upper end of pressure chamber 106. Housing lock ring 116 abuts against shoulder 120 of conductor housing 112 to retain conductor housing 112 within pressure chamber 106. Seal 122 prevents fluid flow between an outer circumference of conductor housing 112 and an interior diameter of pressure chamber 106.

Electrical conductor assembly 114 is electrically insulated within conductor housing 112 by insulator 124, insulator 126, insulator 128, and insulator 130, which are made from polytetrafluoroethylene, which is available from E. I. DuPont De Nemours and Company under the registered trademark TEFLON®. Electrical conductor assembly 114 includes upper conductor pin 132, conductor spring 134, conductor rod 136, and lower conductor pin 138. Conductor spring 134 is compressed so that it presses against upper conductor pin 132 and lower conductor rod 136 to both provide electrical contact therebetween, and to press conductor rod 136 into lower conductor pin 138.

Power lead screw 140 threads into a lower end of lower conductor pin 138. Ground lead screw 142 threads into a lower face of conductor housing 112. Power lead 144 is connected by power lead screw 140 to electrical conductor assembly 114. Ground lead 146 is connected by ground lead screw to conductor housing 112 which provides an electrical ground for completing an electrical circuit from wireline tool string T (shown in FIG. 1), through electrical conductor assembly 114, to resistance heater 104 within power charge 102, and to ground lead 146.

Power charge 102 of the preferred embodiment of the present invention includes resistance heater 104, chemical components 148, and power charge housing 150. Power lead 144 and ground lead 146 extend from resistance heater 104 through a portion of chemical components 148, and through power charge housing 150 to provide an electrical connection for providing power to resistance heater 104. In the preferred embodiment of the present invention, chemical components 148 serve as a propellant which burn to generate a pressurized gas which urges floating piston 18 downwards.

In the preferred embodiment of the present invention, propellant 148 is made of a standard-service, solid propellant mixture which includes, but is not necessarily limited to, a mixture of the following chemical components: potassium perchlorate, gilsonite resin, strontium nitrate, diatomaccous earth, and toluene.

The standard mixture for the preferred embodiment of propellant 148 are the same materials which were utilized in prior art power charge 70. However, in the preferred embodiment of the present invention, propellant 148 in power charge 102 is directly ignited to burn in a combustion reaction by heat from resistance heater 104, rather than being ignited by either a primary or a secondary igniter burning to generate heat for igniting the prior art propellant in prior art power charge 70.

As discussed above, prior art primary igniters, such as primary igniter 78, utilize gunpowder and prior art secondary igniters, such as secondary igniter 80, also utilize an explosive mixture. However, in the preferred embodiment of the present invention, power charge 102 is ignited without use of explosive materials, but rather is directly ignited by heat electrically generated from resistance heater 104. A primary or secondary chemical reaction, such as an explosion, is not utilized.

In the preferred embodiment of the present invention, resistance heater 104 is a 5-watt wire-wound resister which is sealed within chemical components 148 in power charge housing 150. Power charge propellant 148 and resistance heater 104 are packaged into a singular package, or container, power charge housing 150, for storage, transport, and insertion into wellbore tool 100. Propellant 148 is self-contained since it is packaged within the container for power charge 102, which in the preferred embodiment of the present invention is a singular container, power charge housing 150.

Operation of wellbore tool 100 is now discussed with reference to FIGS. 1, 2, and 4. Electrical power is provided from electrical power supply E, through wireline W and to wireline tool string T. Electrical power then passes from wireline tool string T, through electrical conductor assembly 114, power lead screw 140, and power lead 144 to resistance heater 104. The electrical circuit is completed by ground lead 146 which is affixed by ground lead screw 142 to conductor housing 112.

Approximately five to ten times the wattage rating for resistance heater 104 is passed through resistance heater 104. Resistance heater 104 generates heat which then directly ignites chemical components 148, without use of a primary or a secondary igniter, or explosive materials. Ignition of chemical components 148 causes them to burn in a self-sustained combustion reaction and a pressurized gas is generated. The pressure of the pressurized gas then builds within pressure chamber 106 to urge floating piston 18 downward.

Movement of floating piston 18 downward pushes hydraulic fluid 66 through orifice 28 and flow port 26 to push secondary piston 34 downward. Secondary piston 34 is connected to piston rod 38, cross link 56, and sleeve 58. Movement of secondary piston 34 downward within lower cylinder 30 moves sleeve 58 downward with respect to mandrel 48. Relative movement of sleeve 58 with respect to mandrel 48 is applied to a downhole tool, such as packer P, for applying a force over a distance to set packer P within casing C. (Packer P not shown in a set position.)

In the preferred embodiment of the present invention, power charge 102 will burn in a self-sustained chemical reaction, which, in the preferred embodiment of the present invention, is a combustion reaction for generating gas. The combustion reaction of the preferred embodiment is a slow combustion reaction, burning at a rate so that a maximum level of gas pressure within pressure chamber 106 will not be reached before a one second period of time has elapsed. This is to be distinguished from explosive reactions in which explosive material is either detonated, deflagrated, or generally burns with a rate of reaction which takes no more than a time period of several milliseconds to burn the explosive materials.

The preferred embodiment of the present invention offers several advantages over prior art setting tools. Since a primary and secondary igniter are not used within the wellbore tool 100, and thus explosive materials are not used, wellbore tool 100 is safer for operators.

Further, wellbore tool 100 is also safer since more electrical energy is required for powering resistance heater 104 to provide sufficient heat for igniting the power charge in the preferred embodiment of the present invention than was required for igniting prior art primary igniters to initiate combustion of prior art power charges.

Additionally, the wellbore tool of the preferred embodiment utilizes a power charge and power charge ignition system which may be sold and shipped as a single container rather than having three components, a primary igniter, secondary igniter, and a prior art power charge, some of which are shipped as explosive materials rather than flammable solids under United States Department of Transportation shipping regulations.

Although the wellbore tool of the present invention has been described herein embodied as a wireline conveyed setting tool, it may be used in other embodiments, such as, for example, a tubing conveyed wellbore tool, and is not limited to wireline conveyed setting tools, nor tubing conveyed wellbore tools. While the invention has been shown in only one of its forms, it is thus not limited but is susceptible to various changes and modifications without departing from the spirit thereof.

What is claimed is:

1. A wellbore tool for use to perform work in a wellbore by converting a chemical pressure source into a force exerted over a distance, said wellbore tool comprising:

a pressure chamber within which a plurality of chemical components are selectively initiated to interact in a chemical reaction for generating a gas having a pressure;

a power charge packaged in a singular container for storing, transporting and inserting into said wellbore tool, said power charge including:

said plurality of chemical components which are selectively initiated to interact in said chemical reaction for generating said gas having said pressure within said pressure chamber;

a resistance heater for converting an electrical energy into heat for directly initiating said chemical reaction for generating said gas having said pressure;

an electrical power supply and electrical conductor for transmitting said an electrical energy to said resistance heater;

a pressure responsive member which is selectively moved by said gas having said pressure pushing against said pressure responsive member with at least part of said force to urge a volumetric expansion within a volume which includes, at least in part, said pressure chamber; and a driven member to which said pressure responsive member is connected for transferring from said pressure at least part of said force over at least part of said distance.

2. The wellbore tool of claim 1 further comprising:

a firing head for both at least partially containing said gas having said pressure which is generated by said chemical reaction, and transmitting electrical energy to selectively power said resistance heater.

3. The wellbore tool of claim 1 wherein said resistance heater includes:

an electrical circuit having a power connection and a ground connection through which said electrical energy is transmitted to said resistance heater; and a resistive component which converts said electrical energy into heat for initiating said chemical reaction.

4. The wellbore tool of claim 1, wherein said chemical reaction for generating gas is a combustion reaction occurring at a slow rate of reaction which takes at least one second to provide a maximum level of said pressure within said wellbore tool.

5. The wellbore tool of claim 1, further comprising:

an intermediate fluidic medium for connecting, at least in part, said pressure responsive member to said driven member for transferring therebetween at least part of said force over said distance.

6. A wellbore tool for use to perform work within a wellbore by converting a chemical pressure source into a force exerted over a distance, said wellbore tool comprising:

a pressure chamber within which a plurality of chemical components are selectively initiated to interact in a slow chemical reaction for generating a gas having a pressure;

a power charge which includes a plurality of chemical components which are selectively initiated to interact in a slow chemical reaction which generates said gas having said pressure, said slow chemical reaction for generating said gas taking at least one second to generate a maximum level of said pressure within said wellbore tool;

a resistance heater for converting an electrical energy into heat for directly initiating said chemical reaction for generating said gas having said pressure;

an electrical power supply and electrical conductor for transmitting said an electrical energy to said resistance heater;

a pressure responsive member which is selectively moved by said gas having said pressure pushing against said pressure responsive member with at least part of said force to urge a volumetric expansion within a volume which includes, at least in part, said pressure chamber; and a driven member to which said pressure responsive member is connected for transferring from said pressure at least part of said force over at least part of said distance.

7. The wellbore tool of claim 6 further comprising:

a firing head for at least partially containing said gas having said pressure which is generated by said chemical reaction, and said firing head transmitting said electrical energy from said electrical power supply to said resistance heater.

8. The wellbore tool of claim 6 wherein said resistance heater includes:

a power circuit having a power connection and a ground connection through which said electrical energy is transmitted to said resistance heater; and a resistive component which converts said electrical energy into heat for initiating said chemical reaction.

9. The wellbore tool of claim 6, further comprising:

an intermediate fluidic medium for connecting, at least in part, said pressure responsive member to said driven member for transferring therebetween at least part of said force over said distance.

10. An apparatus for use in a wellbore to operate a downhole tool by providing a force to move a sleeve relative to a mandrel, said apparatus comprising:

a pressure chamber within which a plurality of chemical components are selectively initiated to interact in a slow chemical reaction for generating a gas having a pressure;

a plurality of chemical components which are selectively initiated to interact in a slow chemical reaction which generates said gas having said pressure within said apparatus;

a resistance heater for converting an electrical energy into heat for directly initiating said chemical reaction for generating said gas having said pressure;

an electrical power supply and electrical conductor for transmitting said an electrical energy to said resistance heater;

a pressure responsive member which is selectively moved by said gas having said pressure pushing against said pressure responsive member with at least part of said force to urge a volumetric expansion within a volume which includes, at least in part, said pressure chamber; and said sleeve to which said pressure responsive member is connected for transferring from said pressure at least part of said force over at least part of said distance.

11. The wellbore tool of claim 10 further comprising:

a firing head for at least partially containing said gas having said pressure which is generated by said chemical reaction, and said firing head transmitting said electrical energy from said electrical power supply to said resistance heater.

12. The apparatus of claim 10 wherein said plurality of chemical components for generating said gas having said pressure includes at least an oxidizer and a propellant fuel; and wherein said chemical reaction is a slow combustion reaction which burns said propellant fuel, said slow combustion reaction taking at least one second for generating a maximum level of said pressure within said apparatus.

13. The apparatus of claim 10 further comprising:

an adapter for connecting said apparatus to a wireline for both conveying said apparatus and downhole tool into said wellbore, and for transmitting said electrical energy to selectively power said resistance heater.

14. The apparatus of claim 10, wherein said downhole tool includes a sealing and gripping mechanism; and wherein said apparatus is included in a setting tool for selectively transmitting said force by relative movement between said sleeve and said mandrel for urging said sealing and gripping mechanism into a sealing and gripping engagement within said wellbore.

15. A setting tool for converting a self-contained solid propellant into work for urging a settable wellbore tool into a gripping and sealing engagement within a wellbore, said setting tool including:

a pressure chamber within which at least a portion of a self-contained solid propellant is selectively initiated to react in a chemical reaction for generating a pressurized gas;

a power charge which includes said self-contained solid propellant within at least a singular package for storage, transport and insertion of said self-contained solid propellant into said setting tool;

a resistance heater for converting an electrical energy into heat for directly initiating said chemical reaction for converting at least a portion of said self-contained solid propellant into said pressurized gas;

an electrical power supply and electrical conductor for transmitting said an electrical energy to said resistance heater;

a pressure responsive member which is moved by said pressurized gas pushing against said pressure responsive member with a force which moves said pressure responsive member over a distance for a volumetric expansion of a volume which includes, at least in part, said pressure chamber; and wherein said pressure responsive member transmits at least a portion of said force over at least a portion of said distance for setting said settable wellbore tool in said gripping and sealing engagement within said wellbore.

16. The setting tool of claim 15 further comprising:

a firing head for at least partially containing said pressurized gas which is generated by said chemical reaction, said firing head transmitting said electrical energy from said electrical power supply to said resistance heater.

17. The setting tool of claim 15, wherein said chemical reaction is a slow combustion reaction which burns said at least a portion of said self-contained solid propellant at a rate which takes at least one second for said pressurized gas to reach a maximum pressure level within said setting tool.

18. The setting tool of claim 15, wherein said chemical reaction is a slow combustion reaction which burns said at least a portion of said self-contained solid propellant at a rate which takes at least one second for said pressurized gas to reach a maximum pressure level within said setting tool, and said setting tool further comprises:

said self-contained solid propellant including potassium perchlorate, gilsonite resin, strontium nitrate, and diatomaccuous earth.

19. The setting tool of claim 15 further comprising:

a head adapter for securing said setting tool to a wireline used for suspending and positioning said setting tool within a wellbore, and said wireline further positioning said settable wellbore tool, which is releasably secured to said setting tool, within said wellbore.

20. The setting tool of claim 15 further comprising:

a wire-wound resistor which is included as a heating element within said resistance heater for converting said electrical energy into heat for directly initiating said chemical reaction of said self-contained solid propellant.

* * * * *